US010431904B2

(12) United States Patent
Wilkins et al.

(10) Patent No.: US 10,431,904 B2
(45) Date of Patent: Oct. 1, 2019

(54) ANTENNA ARRAY ASSEMBLY AND METHOD OF CONSTRUCTION THEREOF

(71) Applicant: Cambium Networks Ltd, Ashburton, Devon (GB)

(72) Inventors: Adam Wilkins, Plymouth (GB); Nigel Jonathan Richard King, Rattery (GB); Carl Morrell, Kingsteignton (GB); Paul Clark, Paignton (GB); Peter Strong, Ipplepen (GB)

(73) Assignee: CAMBIUM NETWORKS LTD, Ashburton, Devon (GB)

( * ) Notice: Subject to any disclaimer, the term of this patent is extended or adjusted under 35 U.S.C. 154(b) by 7 days.

(21) Appl. No.: 15/675,309

(22) Filed: Aug. 11, 2017

(65) Prior Publication Data

US 2017/0365934 A1 Dec. 21, 2017

Related U.S. Application Data

(63) Continuation of application No. PCT/GB2016/050347, filed on Feb. 12, 2016.

(30) Foreign Application Priority Data

Feb. 13, 2015 (GB) ..... 1502457.3

(51) Int. Cl.
*H01Q 1/38* (2006.01)
*H01Q 21/06* (2006.01)
(Continued)

(52) U.S. Cl.
CPC ..... *H01Q 21/065* (2013.01); *H01Q 9/045* (2013.01); *H01Q 9/0421* (2013.01); *H01Q 1/246* (2013.01); *H01Q 1/38* (2013.01); *H01Q 1/42* (2013.01)

(58) Field of Classification Search
CPC ..... H01Q 1/246; H01Q 1/24; H01Q 1/38; H01Q 1/42; H01Q 21/065; H01Q 21/06; H01Q 9/0421; H01Q 9/045; H01Q 9/04
See application file for complete search history.

(56) References Cited

U.S. PATENT DOCUMENTS 3,950,204 A 4/1976 Williams
4,816,835 A * 3/1989 Abiko ..... H01Q 21/0075 343/700 MS
(Continued)

FOREIGN PATENT DOCUMENTS

EP 0312989 10/1988
EP 384780 8/1990
(Continued)

OTHER PUBLICATIONS

International Search Report and Written Opinion of the International Searching Authority for Corresponding International Application No. PCT/GB/2016050347, dated Jun. 17, 2016, 11 pages.

*Primary Examiner* — Tho G Phan
(74) *Attorney, Agent, or Firm* — Brinks Gilson & Lione

(57) ABSTRACT

An antenna array assembly comprises a dielectric film (2) carrying an array of conductive patch radiator elements (7) and a plurality of conductive feed tracks and a ground plate (1), a face of the ground plate (1) having a contoured shape comprising a first part configured to be in contact with the dielectric film (2), and a second part comprising sunken sections with respect to the first part arranged to underlie the conductive feed tracks and conductive patch radiator elements (7), and the ground plate having locating protrusions (6*g*, 6*f*) protruding from the first part. The dielectric film is attached to the ground plate by location of holes in the dielectric film with the locating protrusions (6*g*, 6*f*) such that the dielectric film is held under tension to maintain spacing of the dielectric film (2) from the sunken sections of the
(Continued)

ground plate (1) without the use of a dielectric spacer layer between the dielectric film (2) and the ground plate (1).

18 Claims, 7 Drawing Sheets

(51) Int. Cl.

| | |
|---|---|
| ***H01Q 9/04*** | (2006.01) |
| *H01Q 1/24* | (2006.01) |
| *H01Q 1/42* | (2006.01) |

(56) References Cited

U.S. PATENT DOCUMENTS

| | | | | |
|---|---|---|---|---|
| 5,181,042 | A * | 1/1993 | Kaise | H01Q 21/0075 343/700 MS |
| 5,210,542 | A | 5/1993 | Pett et al. | |
| 5,243,354 | A * | 9/1993 | Stern | H01Q 21/08 333/1.1 |
| 5,394,119 | A * | 2/1995 | Pleva | H01Q 1/28 333/260 |
| 5,453,751 | A * | 9/1995 | Tsukamoto | H01Q 15/242 343/700 MS |
| 5,477,231 | A | 12/1995 | Medard | |
| 5,990,835 | A | 11/1999 | Kuntzsch et al. | |
| 6,087,989 | A * | 7/2000 | Song | H01Q 9/285 343/700 MS |
| 9,837,697 | B2 * | 12/2017 | Strong | H01P 5/028 |
| 2014/0184455 | A1 | 7/2014 | Lea et al. | |

FOREIGN PATENT DOCUMENTS

| | | |
|---|---|---|
| EP | 892461 | 1/1999 |
| GB | 2212987 | 8/1989 |
| GB | 2430309 | 3/2007 |

* cited by examiner

ANTENNA ARRAY ASSEMBLY AND METHOD OF CONSTRUCTION THEREOF

RELATED APPLICATIONS

The present patent document is a continuation of PCT Application Serial No. PCT/GB2016/050347, filed Feb. 12, 2016, designating the United States and published in English, which is hereby incorporated herein by reference. This application claims the benefit of UK Application number GB 1502457.3 filed Feb. 13, 2015, which is hereby incorporated herein by reference.

TECHNICAL FIELD

The present invention relates generally to antenna array assembly and a method of construction thereof, and more specifically, but not exclusively, to a assembly for an array of antenna elements for use in a radio transceiver in user equipment of a fixed wireless access system.

BACKGROUND

In modern wireless systems, such as for example cellular wireless and fixed radio access wireless networks, there is a need for equipment operating with radio frequency signals, such as radio transceiver equipment in user equipment or at base stations or access points, which is economical to produce, while having high performance at radio frequencies. Increasingly high radio frequencies are being used as spectrum becomes scarce and demand for bandwidth increases. Furthermore, antenna systems are becoming increasingly sophisticated, often employing arrays of antenna elements to provide controlled beam shapes and/or MIMO (multiple input multiple output) transmission.

It is known to implement a radio transceiver having an array of antenna elements, which may be formed as copper areas printed on a dielectric film, for example a polyester film. A feed network is also printed on the dielectric film, to connect the antenna elements to the transmit and receive chains of the transceiver. A ground plate is provided, which underlies the film, and which provides a radio frequency ground plane for the antenna array and feed network. The ground plate has a top surface which underlies the film by a separation distance, which is arranged to be an appropriate distance to give the desired characteristic impedance for the feed network, in conjunction with the line width of the signal tracks of the feed network. The ground plate may have depressions provided under the antenna elements to improve radiation performance. The separation distance between the film and the ground plate is maintained by providing a dielectric spacer layer between the film and the ground plate, which may be composed of a foam material having low loss properties at radio frequencies. By using a thin film thickness in conjunction with a low loss dielectric spacer layer, the radio frequency loss of the feed network and antenna array is reduced. The film may be made of a material having a relatively high dielectric loss, but because it is thin in comparison with the dielectric spacer layer, the electric fields between ground plate and the feed network and the antenna elements pass through the low loss foam material for most of their length, and so the overall loss is low. An example of such a construction is given in UK patent application GB2296385, applied for by Northern Telecom Limited.

However, if it is desired to produce a compact design, for example using narrow tracks in the feed network, and for example for use at radio frequencies of 5 GHz and higher, then a small separation distance is required between the feed tracks and the ground plane in order to maintain the characteristic impedance of the tracks, and it may be difficult to manufacture and handle a sufficiently thin dielectric spacer layer made from a low loss foam material. It is undesirable to use a thicker film to support the feed network and antenna elements as this may result in a higher loss.

It is an object of the invention to mitigate the problems of the prior art.

SUMMARY

In accordance with a first aspect of the present invention, there is provided an antenna array assembly, comprising:

a dielectric film carrying an array of conductive patch radiator elements and a plurality of conductive feed tracks; and a ground plate, a face of the ground plate having a contoured shape, the contoured shape comprising a first part configured to be in contact with the dielectric film, and a second part comprising sunken sections with respect to the first part arranged to underlie the conductive feed tracks and conductive patch radiator elements, and the ground plate having locating protrusions protruding from the first part, wherein the dielectric film is attached to the ground plate by location of holes in the dielectric film with the locating protrusions, such that the dielectric film is held under tension, whereby to maintain spacing of the dielectric film from the sunken sections of the ground plate without the use of a dielectric spacer layer between the dielectric film and the ground plate.

In an embodiment of the invention, each said hole in the dielectric film has a respective diameter, before assembly, that is less than the diameter of the corresponding locating protrusion, and the dielectric film is attached such that the dielectric film in the region of each hole is raised away from the first part of the ground plate and parts of the dielectric film more distant from each hole are in contact with the first part of the ground plate and held in tension.

Providing a face of the ground plate with a contoured shape comprising a first part arranged to be in contact with the dielectric film allows a separation distance to be maintained between the dielectric film and the second part of the ground plate without the use of a dielectric spacer layer between the film and the ground plate. It has been found that the film may be adequately supported by a suitably shaped first part of the top face of the ground plate, in particular for use with radio frequencies above 5 GHz at which the gaps spanned by the dielectric film are reduced compared to those at lower frequencies. For example, the unsupported distance across a patch radiator is reduced because the required dimensions of a patch radiator reduce with frequency. Holding the film under tension by the location of the holes in the dielectric film with the locating protrusions further enables maintenance of the spacing of the dielectric film from the sunken portions of the ground plate without the use of a dielectric spacer layer between the dielectric film and the ground plate.

In accordance with a second aspect of the present invention, there is provided a method of construction of an antenna array assembly having an array of patch antenna elements, the method comprising:

providing a dielectric film carrying an array of conductive patch radiator elements and a plurality of conductive feed tracks;

providing a ground plate, a face of the ground plate having a contoured shape, the contoured shape comprising a first part configured to be in contact with the dielectric film, and a second part comprising sunken sections with respect to the first part arranged to underlie the conductive feed tracks and the conductive patch radiator elements, and the ground plate having locating protrusions protruding from the first part wherein the shape of the first part is configured to provide support to the dielectric film by extending up to a margin around the conductive feed network and the conductive patch radiator elements, whereby to support the flexible film; and attaching the dielectric film to the ground plate by location of holes in the dielectric film with the locating protrusions, such that the dielectric film is held under tension, whereby to maintain spacing of the dielectric film from the sunken sections of the ground plate without the use of a dielectric spacer layer between the dielectric film and the ground plate.

This allows the dielectric film to be located without the use of a dielectric spacer layer.

In an embodiment of the invention, each said hole in the dielectric film has a respective diameter, before assembly, that is less than the diameter of the corresponding locating protrusion, and attaching the dielectric film comprises applying pressure to the dielectric film in the region of each said hole, so as to dilate the hole and force the dielectric film, in the region of the hole, to slide along the locating protrusion to a position such that the dielectric film in the region of the hole is raised away from the first part of the ground plate and parts of the dielectric film more distant from each hole are in contact with the first part of the ground plate and held in tension.

This provides an efficient method of manufacturing the antenna array assembly such that the dielectric film is kept under tension in the region of the conductive patch radiators and the conductive tracks, and the dielectric film is urged against the first part of the ground plate.

In accordance with a third aspect of the invention there is provided a radio terminal comprising an antenna array assembly according to the first aspect of the invention.

Further features and advantages of the invention will be apparent from the following description of preferred embodiments of the invention, which are given by way of example only.

DETAILED DESCRIPTION

By way of example, embodiments of the invention will now be described in the context of an antenna array assembly having a ground plate which is a backing plate for an array of printed antenna elements in a radio terminal which is a subscriber module of a fixed wireless access system. However, it will be understood that this is by way of example only and that other embodiments may be antenna array assemblies in other wireless systems. In an embodiment of the invention, an operating frequency of approximately 5 GHz is used, but the embodiments of the invention are not restricted to this frequency, and in particular embodiments of the invention are particularly suitable for use at higher operating frequencies of up to 60 GHz or even higher.

Figure 1:
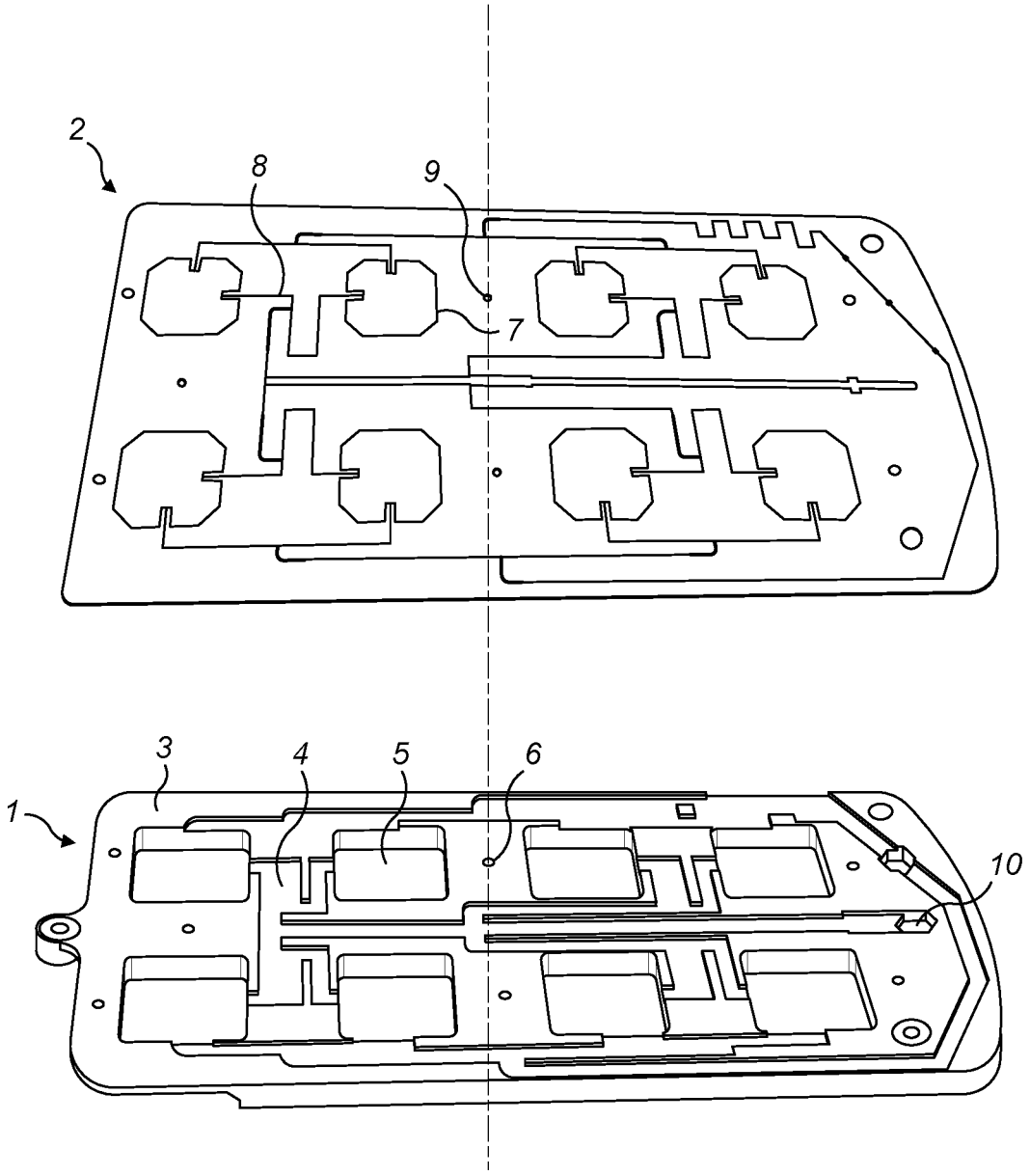
FIG. 1 is a schematic diagram showing an exploded view of an antenna array assembly in an embodiment of the invention.

FIG. 1 is a schematic diagram showing an exploded view of an antenna array assembly in an embodiment of the invention, comprising a ground plate 1 and a dielectric film 2. The dielectric film is typically composed of polyester and typically has a thickness less than 0.05 mm, and as a result the film is typically particularly flexible. As shown in FIG. 1, the dielectric film is assembled directly onto the ground plate without a dielectric spacer layer. The top face of the ground plate has a contoured shape comprising a first part arranged to be in contact with the dielectric film. This allows a separation distance to be maintained between the dielectric film the ground plane formed by the sunken section of the ground plate without the use of the dielectric spacer layer between the film and the ground plate. It has been found that, despite the flexibility of the film, the film may be adequately supported by a suitably shaped first part of the top face of the ground plate. This is particularly advantageous for use with radio frequencies of 5 GHz and above at which the gaps spanned by the dielectric film are reduced compared to those at lower frequencies. An advantage of avoiding the use of a dielectric spacer layer is that a small separation distance may be provided between the feed tracks and the ground plane, typically 0.5 mm or less. This may not be possible if a dielectric spacer is used, because it may be difficult to manufacture and handle a sufficiently thin dielectric spacer layer made from a low loss foam material. A small separation distance enables a compact design, for example using narrow tracks in the feed network. This is particularly useful at radio frequencies of 5 GHz and higher.

As shown in FIG. 1, the dielectric film 2 carries an array of conductive patch radiator elements 7 and a conductive feed network, the feed network comprising feed tracks 8 arranged to connect the conductive patch radiator elements 7 to at least one radio frequency connection arrangement. In one embodiment, the radio frequency connection arrangement may be a coaxial connector, arranged to connect the feed network through aperture 10 in the ground plate to a radio transceiver. Alternatively, the radio frequency connection arrangement may be a wireless via arrangement by which signals are conducted through a slot in the ground plane; this is described in more detail in conjunction with FIG. 4.

Figure 2:
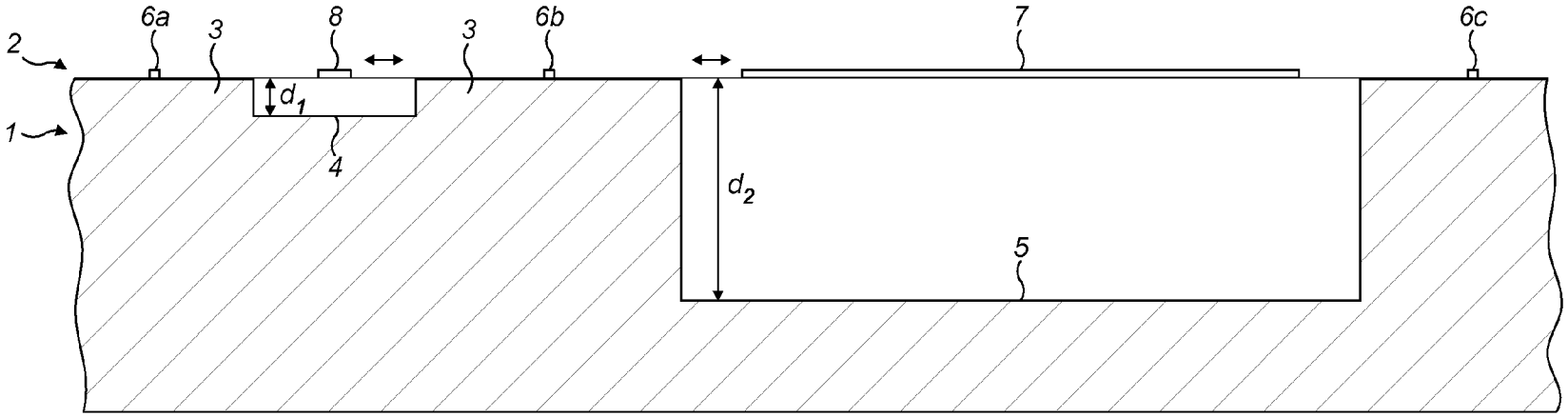
FIG. 2 is a schematic diagram showing a cross section of an antenna array assembly in an embodiment of the invention.

FIG. 2 shows an embodiment of the invention in cross section. As can be seen from FIG. 1 and FIG. 2, the contoured shape comprises a first part 3 arranged to be in contact with the dielectric film, a second part 4 comprising a sunken section with respect to the first part and arranged to underlie the conductive feed network 8 by a first distance $d_1$, and a third part 5 comprising a further sunken sections, each further sunken section being arranged to underlie a conductive patch radiator element 7 by a second distance $d_2$. The second distance is greater than the first distance, so that the patch radiator elements 7 are provided with underlying cavities of a depth which gives good radiation performance. For example, $d_2$ may be typically 3 mm for operation at frequencies of approximately 5 GHz, and $d_1$ may be 0.5 mm. In the embodiments of FIG. 1 and FIG. 2, the second part of the contour is arranged to provide an air gap under the dielectric film, the air gap having a depth of at least 10 times the thickness of the dielectric film. The air gap proves a low dielectric loss between the dielectric film and the ground plate. Having an air gap with a depth of at least 10 times the thickness of the dielectric film reduces the effect of the loss factor of the material of the dielectric film on the loss. Furthermore, having an air gap with a depth of at least 10 times the thickness of the dielectric film reduces the effect on the impedance of signal tracks caused by variations in the air gap depth due to displacement of the flexible film.

As can be seen from FIGS. 1 and 2, the ground plate has locating protrusions 6, 6*a*, 6*b*, 6*c*, which may also be referred to as pips, protruding from the top face and the dielectric film is attached to the ground plate by location of holes 9 in the dielectric film with the locating protrusions. This helps the dielectric film to be correctly located and kept flat even without a dielectric foam spacer. The attachment of the dielectric film to the ground plate by location of holes in the dielectric film with the locating protrusions may be arranged to hold the dielectric film under tension, which further assists in keeping the dielectric film flat and thereby maintaining the separation between the film and the ground plate.

Figure 3:
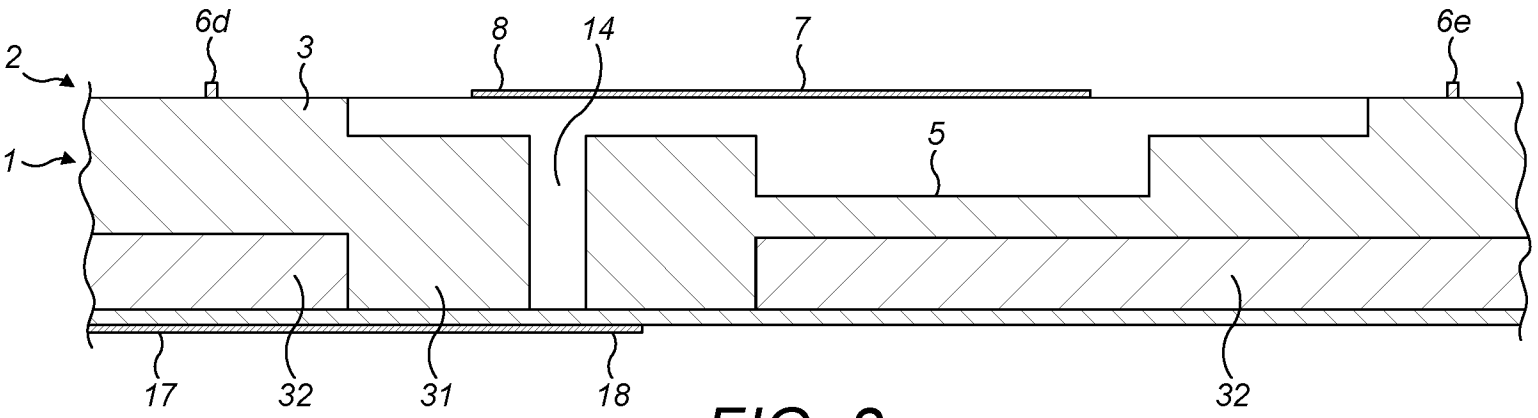
FIG. 3 is a schematic diagram showing a cross section of an antenna array assembly in an embodiment of the invention using an aperture in the ground plate to couple signals through a ground plate.

FIG. 3 shows an embodiment in which the radio frequency connection through the ground plate is provided by an aperture passing through the ground plate from the top face to a second face substantially opposite the top face, the aperture comprising a slot 14. This allows a radio frequency connection to be provided through the ground plate, without the use of expensive coaxial connectors. Furthermore, this increases the tolerance for misalignment between the signal tracks printed on the dielectric film and the ground plate compared with the use of a wired connector, and simplifies manufacturing because no soldering to the dielectric film is required for this connection.

In the embodiment shown in FIG. 3, the ground plate 1 has a protrusion 31 from the second side, the protrusion being arranged to pass through an opening in a metal plate 32 disposed in a substantially parallel relationship with the ground plate. The aperture 14 is arranged to pass through the protrusion 31, so that a radio frequency connection is provided through the metal plate 32 to the second transmission line 17.

The metal plate 32 may be used to reinforce the ground plate, and to provide heat sinking. The ground plate may be plated plastic, which may have poor thermal conductivity. The protrusion of the ground plate surrounding the aperture through a hole in the metal plate avoids the aperture passing through a join between the metal plate and the ground plate, which may otherwise affect the radio frequency performance of the coupling between the first and second transmission lines through the aperture due to the discontinuity of the ground plane.

As can be seen by reference to FIG. 3, it is advantageous to have a thick ground plane, thicker than the width of the slot 14 of the aperture, in order to accommodate the recesses and the metal reinforcing plate between the planes of the first and second transmission lines. The ground plate 1 may be provided with protrusions 6*d*, 6*e* to locate the film.

Figure 4:
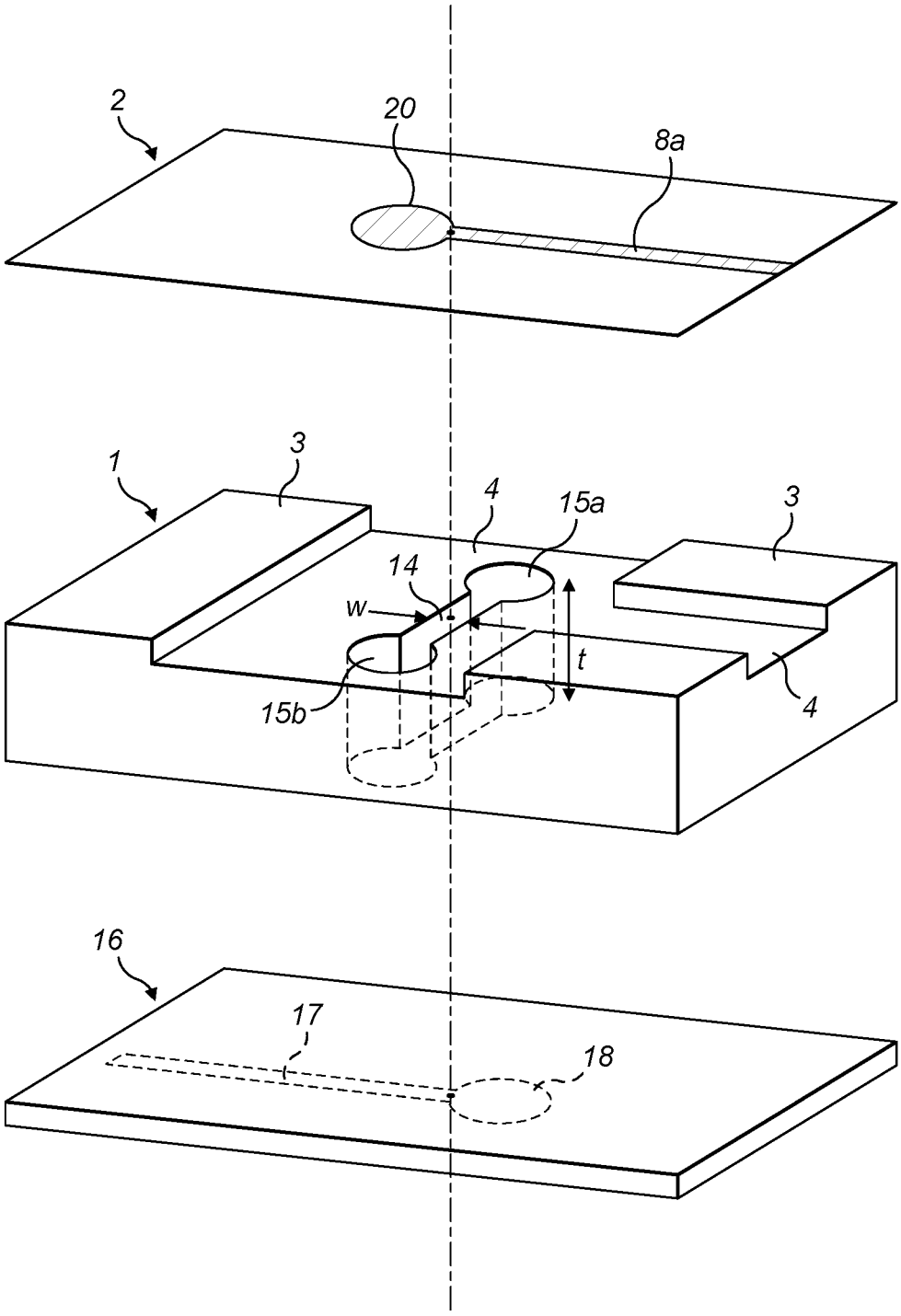
FIG. 4 is a schematic diagram showing an exploded view of a radio frequency transmission arrangement in an embodiment of the invention for coupling signals through a ground plate.

FIG. 4 shows an exploded view of a radio frequency connection arrangement in an embodiment of the invention arranged to connect radio frequency signals from a first transmission line comprising signal conductor 8*a* through the ground plate 1, to a second transmission line on the other side of the ground plate comprising signal conductor 17. As can be seen in FIG. 1, the ground plate 1 is provided with an aperture 14, 15*a*, 15*b* passing through the ground plate from the one side of the ground plate 1 to the opposite side. The thickness of the ground plane t is greater than the width of the slot w, typically by a factor of 4 or more. A slot width of 2 mm has been found to give good coupling performance with a ground plane thickness of 10 mm, for example. Signals are coupled through the aperture from the first transmission line to the second transmission line, and vice versa. This allows signals to be coupled through the ground plate without an electrically conductive connection between the conductors of the first and second transmission lines. As a result, the use of co-axial connectors is avoided, saving cost, and mechanical construction tolerances are relaxed, in particular when more than one connection is provided through a ground plate. Furthermore, this provides a connection which causes low loss to radiofrequency signals, and avoids introducing intermodulation distortion due to metal-to-metal connections.

As shown in FIG. 4, the ground plate 1 has first and second opposite sides, the first side being referred to as a top face, and an aperture 14, 15*a*, 15*b* passing through the ground plate from the first side to the second side, the aperture comprising a slot 14. As can be seen, the slot 14 has an elongate cross-section in the plane of the first side of the ground plate, and the cross-section has substantially parallel sides extending along the length of the cross section. The slot has a width w which is the distance between the parallel sides of the cross-section of the slot as shown in FIG. 4.

Signal transmission in the connection arrangement is reciprocal, so the arrangement may be used to connect radio frequency signals from the first transmission line to the second transmission line or from the second transmission line to the first transmission line. The first transmission line comprises a signal track, or first elongate conductor, 8*a*, which in the embodiment of FIG. 4 is printed on a dielectric film 2, and the ground plate 1 provides a ground reference for the first transmission line. The ground plate may be a backing plate providing a ground reference and mechanical support for an array of patch antenna elements which are connected to the first transmission line by a feed network.

The second transmission line comprises a second signal track, or second elongate conductor 17 printed on a dielectric substrate 16 and the ground plate 1 similarly provides a ground reference for the second transmission line. The second transmission line may be connected to a radio transceiver circuit board, the radio transceiver being arranged to transmit and/or receive using the antenna array. The ground plate may have a substantially planar surface underlying the first transmission line, which may include apertures or hollows, for example resonant cavities for patch antennas, and may have a non-uniform cross-section, for example comprising fixing posts. The ground plate may, for example, be milled from an aluminium block, cast, or moulded. The term "ground" is used to mean a radio frequency reference, for example for an unbalanced transmission line, which does not necessarily require a direct current (DC) connection to an electrical ground or earth. The first and second transmission lines are unbalanced transmission lines referenced to the ground plate.

Figure 5:
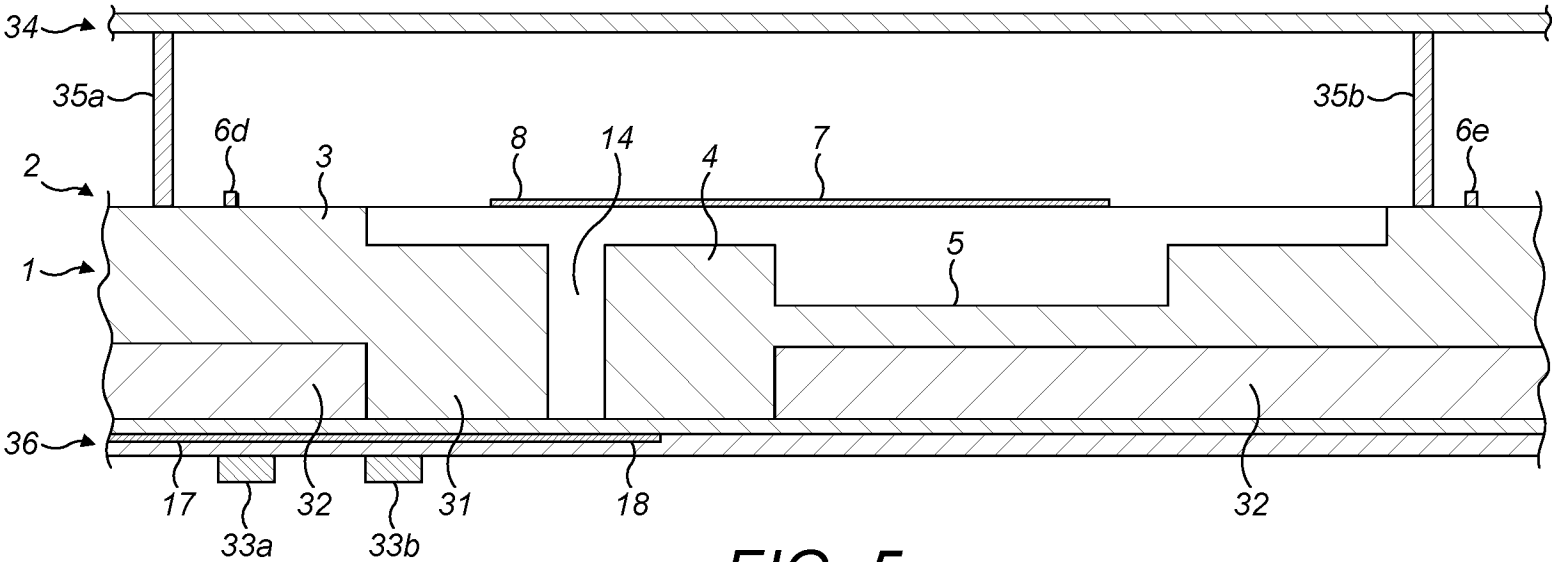
FIG. 5 is a schematic diagram showing a cross section through a radio terminal having a radome covering the patch radiator elements and a transceiver mounted on the opposite side of the ground plate from the patch radiator elements.

As may be seen, the first transmission line comprises a first elongate conductor 8*a* disposed on the first side of the ground plate in a substantially parallel relationship with the first side of the ground plate. As can be seen in FIG. 5, the first transmission line is formed by a printed track on a polyester film 2, disposed with an air gap between the polyester film and the ground plate. The polyester film may be very thin, typically 0.05 mm or less thick. This reduces dielectric loss effects as the electric fields between the conductor and the ground plate are mainly in air. This gives a low loss implementation with good coupling. As shown in FIG. 4, raised sections 3 of the ground plate are be provided to support the polyester film, or film made of another dielectric material, maintaining the air gap. The second transmission line may be formed with a dielectric film and air gap in a similar manner to the first transmission line.

The second transmission line comprises a second elongate conductor 17 disposed on the second side of the ground plate 1 in a substantially parallel relationship with the second side of the ground plate. As can be seen in FIG. 4, the second transmission line has the second elongate conductor 17 terminated with a termination stub 18. In the embodiment shown in FIG. 4, the terminating stub 18 of the second transmission line has a diameter of substantially 0.1 of a wavelength at an operating frequency of the radio frequency transmission assembly, which has been found to provide a low loss implementation. The terminating stub 18 provides a match to the characteristic impedance of the transmission line, which may be typically 50 Ohms, in conjunction with the impedance presented by the aperture. A skilled person would understand that the terminating stubs may have other shapes than those illustrated. Shapes could be developed using a computer simulation package to give a good impedance match and so a low return loss. In the embodiment of FIG. 4, the first transmission line has the first elongate conductor 8*a* also terminated with a termination stub 20, typically having the same dimensions as the terminating stub of the second transmission line.

It can be seen that the first transmission line is arranged to cross the slot, in the embodiment of FIG. 4 at a point adjacent to the termination stub 20, and the second transmission line is also arranged to cross the slot, at a point adjacent to the termination stub 18.

As shown in the embodiment of FIG. 4, the aperture is an air-filled cavity. It has been found that an air-filled cavity gives low loss characteristics. In alternative embodiments, the aperture may be filled with a dielectric.

In embodiments of the invention, the ground plate may be composed of a non-conductive moulding, for example a moulding of a plastics material, having an electrically conductive coating, for example copper, allowing the ground plate to be light weight and to be moulded in a shape to include the aperture. This may provide an economical manufacturing method, and it has been found that apertures may be economically produced by moulding. In particular, it has been found that apertures having slots of width of 2 mm or greater are particularly suitable for production by moulding.

Alternatively, the ground plate may be composed of metal, for example cast aluminium, which may provide good strength.

It has been found that the width of the slot is advantageously greater than 1 mm and the thickness of the ground plate is advantageously greater than 5 mm. Preferably, the width of the slot is in the range 1 to 3 mm and the thickness of the ground plate is in the range 5 to 15 mm. This provides a combination of low loss radio frequency coupling and economical manufacturing due to the avoidance of tight dimensional tolerances.

In the embodiment shown in FIG. 4, the aperture comprises a cylindrical termination cavity 15*a*, 15*b* at each end of the slot 14. This improves coupling of radio frequency signals through the aperture, giving low loss. In an embodiment of the invention, the slot has a length of less than a wavelength at an operating frequency of the radio frequency transmission arrangement, which improves coupling of radio frequency signals through the aperture, giving low loss. It has been found that a slot having a length of less than 0.3 of a wavelength at an operating frequency of the radio frequency transmission arrangement gives a compact implementation of the radio frequency transmission arrangement with low loss. Typically a slot length of 0.2 wavelengths, the slot length excluding the diameter of the cylindrical terminating cavities 15*a*, 15*b*, has been found to give good performance, and each said substantially cylindrical terminating cavity having a diameter of substantially 0.1 of a wavelength at an operating frequency of the radio frequency transmission structure has also been found to give good performance, providing a low loss implementation.

In the embodiment shown in FIG. 4, the first transmission line crosses the slot directly opposite the point where the second transmission line crosses the slot, allowing the first transmission line to be arranged to be directly above the second transmission line.

In an embodiment of the invention the first transmission line may cross the slot at a point offset along the slot from the point where the second transmission line crosses the slot. This allows the first and second transmission lines to be offset horizontally. This may be convenient in some circuit layouts.

In the embodiments shown in FIGS. 1 and 2, it can be seen that the first part 3 of the ground plate, which supports the film 2, is substantially planar and is shaped so as not to underlie the conductive feed network or the conductive patch radiator elements and to provide at least a margin around the feed network and patch radiator elements. The margin can be seen in particular in FIG. 2. Preferably, the margin has a width of greater than twice the first distance, that is to say twice the depth of the recess under the feed network, to allow support of the dielectric film by the first part of the top face of the ground plate, while minimising the effect of the proximity of the ground plate on the electrical performance. Also, the second distance, being the depth of the recess under the patch radiator elements, is preferably at least 5 times the depth of the recess under the feed network. This gives good radiation performance from the patch radiator elements while maintaining convenient feed track dimensions.

In an embodiment of the invention, the second distance is at least 2 mm. Preferably, the thickness of the planar dielectric substrate is less than a tenth of the width of a 50 Ohm feed track. This reduces signal loss.

As shown in FIG. 5, in an embodiment of the invention, the antenna array assembly may comprise a radome 34 attached the ground plate and arranged to cover the top face of the ground plate. A radome is a cover that is transparent to radiofrequency radiation, and which provides environmental protection to the antenna and may form a part of the enclosure of a radio terminal. The attachment to the ground plate is not shown in FIG. 6. The attachment may be directly to the ground plate, typically ay the edges, or may be an indirect attachment by part of a radio terminal to which the ground plate is also attached. As can be seen in FIG. 5, the radome has pillars 35*a*, 35*b* configured to bear against the dielectric film 2, which help locate the dielectric film to the ground plate.

An antenna array assembly according to an embodiment of the invention may be used as part of a radio terminal. FIG. 5 shows a cross section of part of a radio terminal comprising a radio transceiver having a printed circuit board 36, on which may be mounted electronic components 33*a*, 33*b*, mounted on the opposite face of the ground plate to the antenna array, the radio transceiver being connected to the radio frequency connection arrangement of the antenna array assembly, in this example a wireless connection arrangement using slot 14.

In an embodiment of the invention, an antenna array assembly may be constructed by attaching the dielectric film to the ground plate by location of holes in the dielectric film with locating protrusions, or pips, on the ground plate. This helps keep the film flat and correctly registered with the ground plate. The holes in the film may be slightly smaller than the pips, so that when the film is pressed onto the pips it is held in place. Also, the spacing of the pips may be arranged so that the film is held slightly in tension. This may further help to make the film lie flat. The shape of the first part of the contoured surface of the ground plate, which is arranged to be in contact with the film, is configured to provide support to the dielectric film by extending up to a margin around the conductive feed network and the conductive patch radiator elements. This support the dielectric and allows the dielectric film to be located without the use of a dielectric spacer layer.

Figure 6:
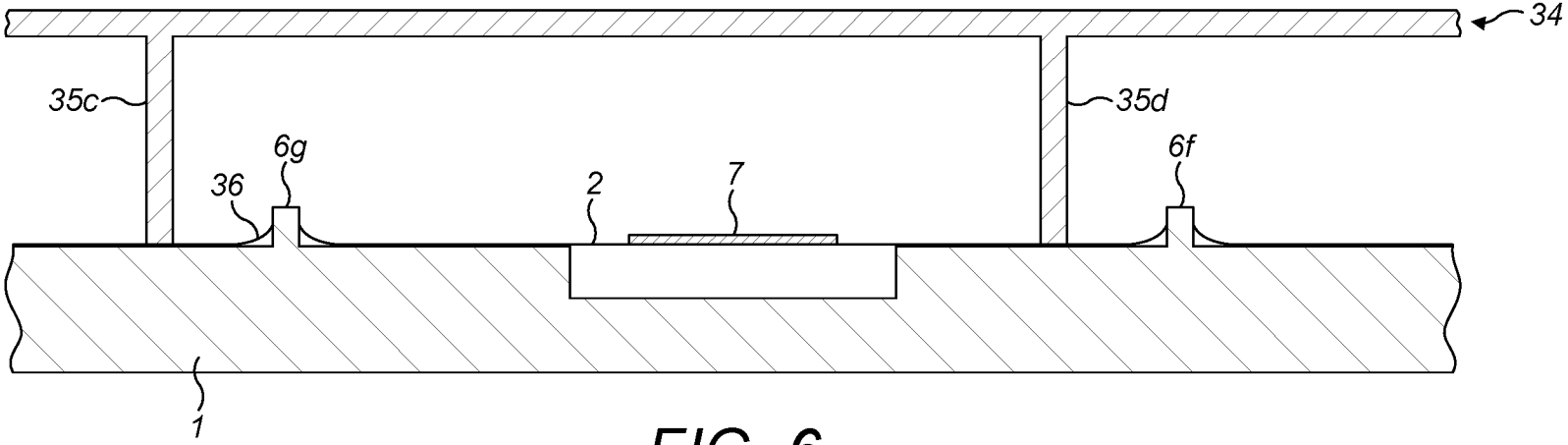
FIG. 6 shows a cross section through an antenna array assembly in an embodiment of the invention.

FIG. 6 shows a cross section through an antenna array assembly in an embodiment of the invention.

The dielectric film 2 carries an array of conductive patch radiator elements 7, one of which is shown, and a plurality of conductive feed tracks (not shown).

The ground plate 1 has face of the ground plate having a contoured shape, the contoured shape comprising a first part configured to be in contact with the dielectric film, and a second part comprising sunken sections with respect to the first part arranged to underlie the conductive feed tracks and conductive patch radiator elements. The ground plate has locating protrusions 6*g*, 6*f* protruding from the first part of the ground plate.

The dielectric film 1 is attached to the ground plate by location of holes in the dielectric film with the locating protrusions 6*g*, 6*f*, such that the dielectric film 1 is held under tension, whereby to maintain spacing of the dielectric film from the sunken sections of the ground plate without the use of a dielectric spacer layer between the dielectric film and the ground plate.

In an embodiment of the invention, each hole in the dielectric film has a respective diameter, before assembly, that is less than the diameter of the corresponding locating protrusion 6*g*, 6*f*, and the dielectric film is attached such that the dielectric film in the region of each hole 36 is raised away from the first part of the ground plate and parts of the dielectric film more distant from each hole are in contact with the first part of the ground plate and held in tension.

This provides an efficient method of keeping the dielectric film flat in the region of the conductive patch radiators and the conductive tracks, and keeping the dielectric against the first part of the ground plate.

Figure 7:
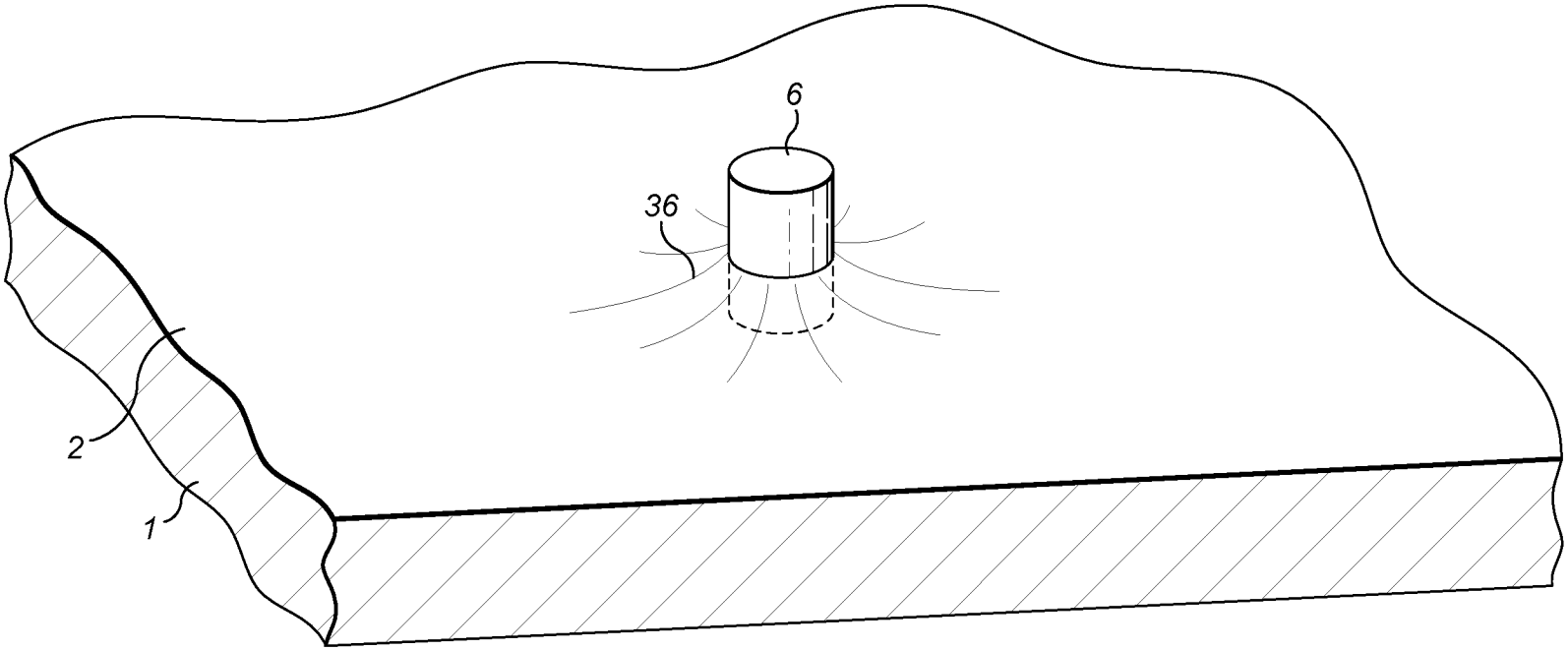
FIG. 7 shows attachment of the dielectric film to the ground plate by location of holes in the dielectric film with the locating protrusions in an embodiment of the invention.

FIG. 7 shows the attachment of the dielectric film 2 to the ground plate 1 by location of holes in the dielectric film with the locating protrusions.

In an embodiment of the invention, each said hole in the dielectric film has a respective diameter, before assembly, that is less than the diameter of the corresponding locating protrusion 6, and attaching the dielectric film comprises applying pressure to the dielectric film in the region of each hole, so as to dilate the hole and force the dielectric film in the region 36 of the hole, to slide along the locating protrusion to a position, as for example shown in FIG. 7, such that the dielectric film in the region 36 of the hole is raised away from the first part of the ground plate and parts of the dielectric film more distant from each hole are in contact with the first part of the ground plate and held in tension.

This provides an efficient method of manufacturing the antenna array assembly such that the dielectric film is kept flat in the region of the conductive patch radiators and the conductive tracks, and the dielectric film is kept against the first part of the ground plate.

As has been described, in an embodiment of the invention, an antenna array assembly is provided comprising:

a dielectric film carrying an array of conductive patch radiator elements and a conductive feed network, the conductive feed network comprising feed tracks arranged to connect the conductive patch radiator elements to at least one radio frequency connection arrangement; and a ground plate, the top face of the ground plate being disposed in a substantially parallel relationship with the dielectric film, wherein the top face of the ground plate has a contoured shape, wherein the contoured shape comprises:

a first part arranged to be in contact with the dielectric film;

a second part comprising a sunken section with respect to the first part and arranged to underlie the conductive feed network by a first distance; and a third part comprising a plurality of further sunken sections, each further sunken section being arranged to underlie a conductive patch radiator element by a second distance, wherein the second distance is greater than the first distance.

Providing the top face of the ground plate with a contoured shape comprising a first part arranged to be in contact with the dielectric film allows a separation distance to be maintained between the dielectric film and the second part of the ground plate without the use of a dielectric spacer layer between the film and the ground plate. It has been found that the film may be adequately supported by a suitably shaped first part of the top face of the ground plate, in particular for use with radio frequencies above 5 GHz at which the gaps spanned by the dielectric film are reduced compared to those at lower frequencies. For example, the unsupported distance across a patch radiator is reduced because the required dimensions of a patch radiator reduce with frequency. The third part of the contoured shape of the ground plate provides cavities under each patch radiator element to improve the radiation performance.

In an embodiment of the invention, the second part is arranged to provide an air gap under the dielectric film, the air gap having a depth of at least 10 times the thickness of the dielectric film.

The air gap proves a medium with low dielectric loss, that is to say air, between the dielectric film and the ground plate. Having an air gap with a depth of at least 10 times the thickness of the dielectric film reduces the effect of the loss factor of the material of the dielectric film on the loss. Furthermore, having an air gap with a depth of at least 10 times the thickness of the dielectric film reduces the effect on the impedance of signal tracks caused by variations in the air gap depth due to displacement of the film.

In an embodiment of the invention, the dielectric film has a thickness less than 0.05 mm.

This provide a low loss implementation.

In an embodiment of the invention, the dielectric film is composed of polyester.

This provides a beneficial combination of mechanical and electrical properties.

In an embodiment of the invention, the ground plate has locating protrusions protruding from the top face and the dielectric film is attached to the ground plate by location of holes in the dielectric film with the locating protrusions.

This allows the dielectric film to be correctly located and kept flat even without a dielectric foam spacer.

In an embodiment of the invention, the attachment of the dielectric film to the ground plate by location of holes in the dielectric film with the locating protrusions is arranged to hold the dielectric film under tension.

This further assists in keeping the dielectric film flat and thereby maintaining the separation between the film and the ground plate.

In an embodiment of the invention, the radio frequency connection arrangement comprises:

an aperture passing through the ground plate from the top face to a second face substantially opposite the top face, the aperture comprising a slot having an elongate cross-section in the plane of the top face of the ground plate, the cross-section having substantially parallel sides extending along the length of the cross section, and the slot having a width which is the distance between the parallel sides of the cross-section of the slot;

a first transmission line connected to a feed track of the conductive feed network comprising a first elongate conductor disposed in a substantially parallel relationship with the top face of the ground plate; and a second transmission line comprising a second elongate conductor disposed in a substantially parallel relationship with the second face of the ground plate, the second transmission line having a termination stub, wherein the first transmission line is arranged to cross the slot and the second transmission line is arranged to cross the slot at a point adjacent to the termination stub.

This allows a radio frequency connection to be provided through the ground plate, without the use of expensive coaxial connectors. Furthermore, this increases the tolerance for misalignment between the signal tracks printed on the dielectric film and the ground plate compared with the use of a wired connector, and simplifies manufacturing because no soldering to the dielectric film is required for this connection.

In an embodiment of the invention, the thickness of the ground plate is greater than the width of the slot. This allows the use of a relatively thick ground plate, including the profiled shape of the top face. It is not obvious that the thickness of the ground plate can be thicker than the width of the slot.

In an embodiment of the invention, the first part of the ground plate is substantially planar and is shaped so as not to underlie the conductive feed network or the conductive patch radiator elements and to provide at least a margin around the feed network and patch radiator elements.

This allows the dielectric film to be supported without the use of a dielectric spacer layer.

In an embodiment of the invention, the margin has a width of greater than twice the first distance.

This allows adequate support of the dielectric film by the first part of the top face of the ground plate, while minimising the effect of the proximity of the ground plate on the electrical performance.

In an embodiment of the invention, the second distance is at least 5 times the first distance.

This gives good radiation performance from the patch radiator elements while maintaining convenient feed track dimensions.

In an embodiment of the invention, the second distance is at least 2 mm.

This gives good radiation performance.

In an embodiment of the invention, the thickness of the planar dielectric substrate is less than a tenth of the width of a 50 Ohm feed track.

This reduces signal loss.

In an embodiment of the invention, the ground plate comprises a non-conductive material having a conductive coating.

This provides a low weight ground plate with good radio frequency performance that is economical to manufacture.

In an embodiment of the invention, the antenna array assembly comprises a radome attached the ground plate and arranged to cover the top face of the ground plate, the radome having pillars configured to bear against the dielectric film, whereby to locate the dielectric film to the ground plate.

This may allow the location of the dielectric film to be further improved without impeding the radiation performance.

According an embodiment of the invention, there is provided a method of construction of an antenna array assembly having an array of patch antenna elements, the method comprising:

providing a dielectric film carrying an array of conductive patch radiator elements and a conductive feed network, the feed network comprising feed tracks arranged to connect the conductive patch radiator elements to at least one radio frequency connection arrangement;

providing a ground plate, the top face of the ground plate having a contoured shape, the contoured shape comprising a first part configured to be in contact with the dielectric film, and a second part comprising sunken sections with respect to the first part arranged to underlie the conductive feed network and the conductive patch radiator elements, and the ground plate having locating protrusions protruding from the top face; and attaching the dielectric film to the ground plate by location of holes in the dielectric film with the locating protrusions, wherein the shape of the first part is configured to provide support to the dielectric film by extending up to a margin around the conductive feed network and the conductive patch radiator elements, whereby to support the flexible film.

This allows the dielectric film to be located without the use of a dielectric spacer layer.

In accordance with an embodiment of the invention, there is provided a radio terminal comprising an antenna array assembly according to the first aspect of the invention.

In an embodiment of the invention, the radio terminal comprises a radio transceiver having a printed circuit board mounted on the opposite face of the ground plate to the top face, the radio transceiver being connected to the radio frequency connection arrangement of the antenna array assembly.

This provides an economical and high performance implementation of a radio terminal.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An antenna array assembly, comprising:

a dielectric film carrying an array of conductive patch radiator elements and a plurality of conductive feed tracks; and a ground plate, a face of the ground plate having a contoured shape, the contoured shape comprising a first part configured to be in contact with the dielectric film, and a second part comprising sunken sections with respect to the first part arranged to underlie the conductive feed tracks and conductive patch radiator elements, and the ground plate having locating protrusions protruding from the first part, wherein the dielectric film is attached to the ground plate by location of holes in the dielectric film with the locating protrusions, such that the dielectric film is held under tension, whereby to maintain spacing of the dielectric film from the sunken sections of the ground plate without the use of a dielectric spacer layer between the dielectric film and the ground plate.

2. The antenna array assembly of claim 1, wherein each said hole in the dielectric film has a respective diameter, before assembly, that is less than the diameter of the corresponding locating protrusion, and the dielectric film is attached such that the dielectric film in the region of each hole is raised away from the first part of the ground plate and parts of the dielectric film more distant from each hole are in contact with the first part of the ground plate and held in tension.

3. The antenna array assembly of claim 1, wherein the second part is arranged to provide an air gap under the dielectric film, the air gap having a depth of at least 10 times the thickness of the dielectric film.

4. The antenna array assembly of claim 1, wherein the dielectric film has a thickness less than 0.05 mm.

5. The antenna array assembly of claim 1, wherein the dielectric film is composed of polyester.

6. The antenna array assembly of claim 1, wherein the first part of the ground plate is substantially planar and is shaped so as not to underlie the conductive feed network or the conductive patch radiator elements and to provide at least a margin around the feed network and patch radiator elements.

7. The antenna array assembly of claim 1, wherein the margin has a width of greater than twice the distance between a feed track and the ground plate underlying the feed track.

8. The antenna array assembly of claim 1, wherein the distance between a patch radiator element and the ground plate underlying the patch radiator element is at least 5 times the distance between a feed track and the ground plate underlying the feed track.

9. The antenna array assembly of claim 1, wherein the distance between a patch radiator element and the ground plate underlying the patch radiator element is at least 2 mm.

10. The antenna array assembly of claim 1, wherein the thickness of the planar dielectric substrate is less than a tenth of the width of at least one of the plurality of feed tracks.

11. The antenna array assembly of claim 1, wherein the ground plate comprises a non-conductive material having a conductive coating.

12. The antenna array assembly of claim 1, comprising a radome attached the ground plate and arranged to cover the top face of the ground plate, the radome having pillars configured to bear against the dielectric film, whereby further to locate the dielectric film to the ground plate.

13. A radio terminal comprising an antenna array assembly according to claim 1.

14. The radio terminal according of claim 13, wherein the radio terminal comprises a radio transceiver having a printed circuit board mounted on the opposite face of the ground plate to said face, the radio transceiver being connected to the conductive patch radiator elements by respective feed tracks.

15. A method of construction of an antenna array assembly having an array of patch antenna elements, the method comprising:

providing a dielectric film carrying an array of conductive patch radiator elements and a plurality of conductive feed tracks;

providing a ground plate, a face of the ground plate having a contoured shape, the contoured shape comprising a first part configured to be in contact with the dielectric film, and a second part comprising sunken sections with respect to the first part arranged to underlie the conductive feed tracks and the conductive patch radiator elements, and the ground plate having locating protrusions protruding from the first part wherein the shape of the first part is configured to provide support to the dielectric film by extending up to a margin around the conductive feed network and the conductive patch radiator elements, whereby to support the flexible film; and attaching the dielectric film to the ground plate by location of holes in the dielectric film with the locating protrusions, such that the dielectric film is held under tension, whereby to maintain spacing of the dielectric film from the sunken sections of the ground plate without the use of a dielectric spacer layer between the dielectric film and the ground plate.

16. The method of claim 15, wherein each said hole in the dielectric film has a respective diameter, before assembly, that is less than the diameter of the corresponding locating protrusion, and attaching the dielectric film comprises applying pressure to the dielectric film in the region of each said hole, so as to dilate the hole and force the dielectric film, in the region of the hole, to slide along the locating protrusion to a position such that the dielectric film in the region of the hole is raised away from the first part of the ground plate and parts of the dielectric film more distant from each hole are in contact with the first part of the ground plate and held in tension.

17. The method of claim 15, wherein the dielectric film has a thickness less than 0.05 mm.

18. The method of claim 15, comprising:

attaching a radome to the ground plate, the radome being arranged to cover the top face of the ground plate; and providing pillars attached to the radome configured to bear against the dielectric film, whereby further to locate the dielectric film to the ground plate.

* * * * *